US012024847B2

(12) United States Patent
Winkes

(10) Patent No.: US 12,024,847 B2
(45) **Date of Patent: *Jul. 2, 2024**

(54) PILE-DRIVER ASSEMBLY AND METHOD FOR DRIVING A PILE INTO THE GROUND

(71) Applicant: IQIP HOLDING B.V., Sliedrecht (NL)

(72) Inventor: Jasper Stefan Winkes, Delft (NL)

(73) Assignee: IQIP HOLDING B.V., Sliedrecht (NL)

( * ) Notice: Subject to any disclaimer, the term of this patent is extended or adjusted under 35 U.S.C. 154(b) by 0 days.

This patent is subject to a terminal disclaimer.

(21) Appl. No.: 17/621,085

(22) PCT Filed: Jun. 26, 2020

(86) PCT No.: PCT/NL2020/050425

§ 371 (c)(1),
(2) Date: Dec. 20, 2021

(87) PCT Pub. No.: WO2020/263096

PCT Pub. Date: Dec. 30, 2020

(65) Prior Publication Data

US 2022/0356665 A1 Nov. 10, 2022

(30) Foreign Application Priority Data

Jun. 28, 2019 (NL) ..... 2023408
Jun. 28, 2019 (NL) ..... 2023409

(51) Int. Cl.
*E02D 7/14* (2006.01)
*E02D 7/10* (2006.01)
(Continued)

(52) U.S. Cl.
CPC ..... *E02D 7/10* (2013.01); *E02D 7/14* (2013.01); *E02D 13/005* (2013.01); *E02D 13/04* (2013.01);
(Continued)

(58) Field of Classification Search
CPC .... E02D 7/02; E02D 7/06; E02D 7/10; E02D 7/14; E02D 7/20; E02D 2250/0092; E02D 13/00; E02D 7/08
See application file for complete search history.

(56) References Cited

U.S. PATENT DOCUMENTS 2,184,745 A 12/1939 Kinneman
3,417,828 A 12/1968 Duyster
3,456,741 A 7/1969 James
3,498,391 A 3/1970 Guild et al.
3,797,585 A 3/1974 Ludvigson
3,800,548 A 4/1974 Wisotsky
(Continued)

FOREIGN PATENT DOCUMENTS

CN 1888328 A 1/2007
CN 107288130 A 10/2017
(Continued)

OTHER PUBLICATIONS

U.S. Appl. No. 17/621,091 (Year: 2021).*

*Primary Examiner* — Sunil Singh
(74) *Attorney, Agent, or Firm* — E. Eric Mills; Nicholas P. Stadnyk; Maynard Nexsen PC

(57) ABSTRACT

A pile-driver assembly for driving a pile into the ground, preferably offshore, and a method of driving a pile into the ground using the pile-driver assembly is disclosed. The assembly includes a casing defining a chamber, the chamber being configured to house a fluid. The assembly further includes a positioning element configured to position the casing at or on the pile, wherein at least a portion of the positioning element is positioned between the chamber and the pile. The assembly further includes actuating means, wherein actuation of the actuating means displaces the chamber relative to the positioning element, such that the chamber moves away from the pile, and wherein the actuating means is configured to release the chamber for displacement towards the pile such that a force is exerted by the chamber on the positioning member, to controllably drive the pile into the ground.

18 Claims, 12 Drawing Sheets

(51) Int. Cl.
*E02D 13/00* (2006.01)
*E02D 13/04* (2006.01)

(52) U.S. Cl.
CPC ..... *E02D 2250/0061* (2013.01); *E02D 2250/0092* (2013.01)

(56) References Cited

U.S. PATENT DOCUMENTS

| | | | |
|---|---|---|---|
| 4,060,139 | A | 11/1977 | Adair |
| 4,102,408 | A | 7/1978 | Ludvigson |
| 4,362,216 | A | 12/1982 | Jansz |
| 4,688,646 | A | 8/1987 | Speckhart et al. |
| 6,000,477 | A | 12/1999 | Campling |

FOREIGN PATENT DOCUMENTS

| | | | | |
|---|---|---|---|---|
| DE | 8900692 | U1 | | 3/1989 |
| DE | 202007009474 | U1 | | 12/2008 |
| FR | 1001682 | A | | 2/1952 |
| FR | 2579240 | A1 | * | 9/1986 |
| GB | 808931 | A | | 2/1959 |
| GB | 1180466 | A | | 2/1970 |
| GB | 1266596 | A | | 3/1972 |
| GB | 1576966 | A | | 10/1980 |
| GB | 2312659 | A | | 5/1997 |
| JP | S46019978 | B | | 4/1971 |
| JP | S54048905 | A | | 4/1979 |
| JP | S62253818 | A | | 11/1987 |
| JP | 2009059955 | A | | 3/2009 |
| NL | 7614038 | A | | 6/1977 |
| NL | 7713296 | A | | 6/1978 |
| WO | 0006834 | A1 | | 2/2000 |
| WO | 2006111540 | A1 | | 10/2006 |
| WO | 2013112049 | A1 | | 8/2013 |
| WO | 2015009144 | A1 | | 1/2015 |
| WO | 2018030896 | A1 | | 2/2018 |
| WO | 2020153838 | A1 | | 7/2020 |

* cited by examiner

PILE-DRIVER ASSEMBLY AND METHOD FOR DRIVING A PILE INTO THE GROUND

CROSS REFERENCE TO RELATED APPLICATIONS

This application is a 35 U.S.C. § 371 U.S. national phase entry of International Application No. PCT/NL2020/050425 having an international filing date of Jun. 26, 2020, which claims the benefit of Netherlands Application No. 2023409 filed Jun. 28, 2019 and Netherlands Application No. 2023408 filed Jun. 28, 2019, each of which is incorporated herein by reference in its entirety.

TECHNICAL FIELD

The present invention relates to a pile-driver, and more particularly to a pile-driver suitable for offshore operations. The present invention also relates to a method for driving a pile downward into the ground.

BACKGROUND TO THE INVENTION

Driving a pile into the ground offshore typically involves dropping a ram or hammer on to the top of the pile from some height via a striker plate. To apply the downward impact forces of the hammer over a larger surface area of the top of the pile and to protect the top of the pile from damage, an impact liner of wood has generally been placed between the underside of the strike plate or anvil and the top of the pile (see DE8900692U1). In order to better protect the strike plate and the top of the pile, the use of pressure gas springs, connected to the strike plate, has also been proposed (see DE8900692U1). In order to protect the hammer and the top of the pile from damage from the direct impact of the hammer on the pile, the use of a liquid-filled pressure chamber atop the strike plate, to provide liquid resistance and a trapped gas cushion between the hammer and the top of the pile, has also been proposed (see GB1576966A). For this purpose, the use of a stack of spring disks or a hydraulic block to provide a cushion between the hammer and the a strike plate atop the pile have also been proposed (see U.S. Pat. Nos. 2,184,745A and 3,498,391A). The use of a stack of oil and gas buffers above a hammer to cushion the blow of the hammer on an anvil on the top of a pile has also been described in the so-called HYDROBLOK impact hammer developed by Hollandsche Beton Groep. It has also been proposed to use a column of water over the hammer to provide the downward driving force to the hammer (see WO2018030896, WO2013112049 and WO2015009144).

However, the designs of known pile-drivers have not been well suited for driving large diameter piles into the ground off-shore. Conventional pile-drivers have been limited in the impact forces that their hammers can apply to the tops of piles. With larger piles (typically with rims larger than 6 meters in diameter), the impact forces provided by the hammers of conventional pile drivers have had to be distributed over a much larger area. That is, the force of a conventional hammer has to be distributed from the centre of the pile, where hammer impacts the anvil, to the rim of the pile at this very large diameter. This requires very large anvils in between the hammer and the pile.

SUMMARY OF THE INVENTION

According to a first aspect of the present invention there is provided a pile-driver assembly for driving a pile into the ground, preferably offshore, the assembly including:

a casing defining a chamber, the chamber being configured to house a fluid;

a positioning element configured to position the casing at or on the pile, wherein at least a portion of the positioning element is positioned between the chamber and the pile; and actuating means, wherein actuation of the actuating means displaces the chamber relative to the positioning element, such that the chamber moves away from the pile, and wherein the actuating means is configured to release the chamber for displacement towards the pile such that a force is exerted by the chamber on the positioning member, to controllably drive the pile into the ground.

This arrangement provides a pile-driver assembly that drives a pile into the ground, in particular larger piles (typically with rims larger than 6 meters in diameter) in an efficient manner. In contrast to known hammer arrangements, in this arrangement there is no hammer enclosed within a casing and actively driven into a pile. Instead, the release of a chamber of fluid, for example water, from a distance away from the pile is utilised to drive the pile into the ground. The arrangement allows the use of a chamber with a much larger mass (particularly when filled with fluid) and the 'push' applied by the chamber onto the pile, rather than a driven hammer. Such an arrangement is more subtle and creates less noise then hammer arrangements. The reduction in noise from known arrangements is two-fold. Firstly the peak noise level of each blow is reduced and additionally, the large mass of the chamber is such that fewer impacts are required by the pile-driver and hence the cumulative noise (the number of blows×peak noise per blow).

In addition, the use of a positioning element to position the casing on the pile, allows fine alignment between the casing and the pile (without the need for an intermediate elements, such as an anvil). The force exerted by the casing can then be directly applied to the pile by the positioning element without having to be distributed via an anvil. Both of these factors help avoid unnecessary stresses on the pile or pile-driver assembly, resulting from a mis-alignment between the two. In addition, there is no real impact of parts (for example a metal hammer on a metal anvil) making the operation a low noise piling operation when compared with the prior art assemblies and/or devices.

Aptly, the actuating means is located intermediate the chamber and the at least a portion of the positioning element. Positioning the actuating means in this way (i.e. in a space between the chamber and a portion of the positioning element), assists in the lifting of the entire chamber/casing (that is, the actuating means pushes upwards from below the chamber to lift the chamber) and hence allows the use of larger chambers/casings with a greater mass to drive the pile into the ground.

Aptly, the assembly further comprises buffering means for controllably buffering the force exerted by the chamber on the pile when the pile is driven into the ground. The use of buffering means allows the higher impact energy levels from the high-mass casing/chamber, to be applied more gradually. In making the effect of each impact on a pile last much longer, the peak force and pile vibrations are reduced and thereby the underwater and airborne noise is also reduced. As such, for such arrangements the need for noise mitigation measures (e.g. Noise Mitigation bubble Curtain) during the piling operation is reduced. The more gradual application of impact forces also helps lower driving fatigue of secondary steel parts of the pile-driver (where used) and produce a more homogeneous loading of the pile, thereby reducing stress fluctuations in, as well as installation fatigue of, the pile.

Aptly, the buffering means is integral with the actuating means. That is, the actuating means includes buffering means. This reduces the need for additional components and makes the assembly more simple to construct and maintain. In addition, by combining the buffering means with the actuating means, the buffering means may also be located intermediate the chamber and the at least a portion of the positioning element, without restricting space. In positioning the buffering means in a space between the chamber and the at least a portion of the positioning element, allows easy access for maintenance and other kind of activities.

Aptly, the actuating means comprises at least one actuator. Aptly, the actuating means comprises a central moving element, having an extended position and a retracted position.

Aptly, actuation of the actuating means causes the central moving element to move from the retracted position to the extended position and wherein the actuating means is configured to buffer the force exerted by the chamber on the positioning member as the central moving element moves from the extended position to the retracted position.

Aptly, the actuating means comprises a fluid chamber, configured to house a fluid, wherein an increase in the amount of fluid within the fluid chamber causes the central moving element to move from the retracted position towards the extended position.

Aptly, the actuating means further comprises an additional fluid chamber fluidly coupled to the first fluid chamber, wherein the central moving element is moved between the extended and retracted position depending on the fluid pressure of the fluid chambers.

Aptly, the fluid chambers are fluidly coupled by a valve element. In this manner, the difference of pressure between the chambers can be easily controlled. As a consequence, the assembly can be pre-set to have a pre-tensioned state, which will help avoid a hard impact of the casing against the pile, and therefore the noise reduction is significantly avoided.

Aptly, the actuating means comprises a buffering chamber, configured to house a buffering fluid, wherein the volume of the buffering chamber decreases as the central moving element moves from the extended position to the retracted position.

Aptly, the actuating means comprises regulating means configured to regulate the internal buffering characteristics of the actuating means. Aptly, the regulating means is configured to control the amount of buffering fluid within the buffering chamber. This helps control the volume and pressure of buffering fluid within the buffering chamber and hence the buffering characteristics of the actuating means. By being able to regulate these characteristics, this configuration allows refined use of the dampening means during piling operations, with the buffer effect being tailored to the specifics of the operation in situ and in real time.

Aptly, the at least a portion of the positioning element (that is positioned between the chamber and the pile) is a plate element configured to overlay an upper surface of the pile. Because of the configuration of the casing and positioning element, the forces exerted into the pile are properly distributed onto the entire periphery of the pile and therefore, the piling operation is performed in an energy-efficient manner.

Aptly, the positioning element further comprises a sleeve element releasably connected to an upper portion of the pile. The sleeve element helps maintain the relative position/orientation between the pile and the positioning element and thus provides a steady and stable system.

Aptly, the casing comprises a sleeve portion at an end thereof, wherein the sleeve portion is configured to surround the sleeve element of the positioning element to provide alignment between the positioning element and the casing. In this manner, a secure sleeve assembly is provided (including the sleeve element of the positioning element and the sleeve portion of the casing), which is able to provide stability to the assembly during the piling operation. Additionally, this configuration will allow fine alignment of the assembly during the piling operation. In other words, the sleeve element of the positioning element and the sleeve portion of the casing provide overlapping portions of the casing and positioning element. This helps ensure minimal relative lateral displacement/rotation between the casing and the pile thus improving stability of the pile-driver assembly on the pile.

Aptly, the chamber has a channel extending at least partially therethrough. When the channel extends through the entire chamber, particularly when extending axially through the chamber, a pathway for deployment of a tool is provided (for example a drill, waterjet or the like) therethrough. When the axial channel is positioned coaxially with the axis of a hollow pile, the tool can access and work the soil directly beneath the pile to reduce resistance of the soil plug.

Aptly, the positioning element comprises a guide element configured to extend at least partially through the channel. Aptly, the guide element is configured to extend further through the channel as the chamber moves towards the pile. In other words, the guide element and the channel provide overlapping portions of the casing and positioning element. This helps ensure minimal relative lateral displacement/rotation between the casing and the pile thus providing stability of the pile-driver assembly on the pile.

Aptly, the chamber is filled with fluid via a conduit provided in the wall of the casing, the wall having a valve for controlling the fluid flow. As such, the chamber of the assembly can be filled in-situ, allowing the assembly to be transported to the operation site while empty. The chamber can then be filled up to a desired level depending on the application (i.e. a level appropriate for the desired conditions for driving the pile into the ground).

According to a second aspect of the present invention there is provided a pile-driver assembly for driving a pile into the ground, preferably offshore, the assembly including:

- a casing defining a chamber, the chamber being configured to house a fluid, the chamber comprising a channel extending at least partially therethrough;
- a positioning element configured to position the casing at or on the pile, wherein at least a portion of the positioning element is positioned between the chamber and the pile, wherein the positioning element comprises a guide element, configured to extend at least partially through the channel of the chamber; and
- actuating means,
  - wherein actuation of the actuating means displaces the chamber relative to
  - the positioning element, such that the chamber moves away from the pile, and wherein the actuating means is configured to release the chamber for displacement towards the pile such that a force is exerted by the chamber on the positioning member, to controllably drive the pile into the ground.

This arrangement provides the same advantages as described above for the first aspect of the invention. In addition, the interaction between the guide element and the channel provides increased stability of the pile-driver assembly on the pile.

Apt features of the second aspect of the invention described below, where applicable, have the same advantages as corresponding features of the first aspect of the invention.

Aptly, the actuating means comprises at least one actuator.

Aptly, the assembly further comprises buffering means for controllably buffering the force exerted by the chamber on the pile when the pile is driven into the ground. Aptly, the buffering means comprises at least one buffering element. Aptly, the buffering means is located intermediate the chamber and the positioning element.

Aptly, the buffering means comprises a central moving element, having an extended position and a retracted position. Aptly, the buffering means is configured to buffer the downward force exerted by the chamber on the positioning member as the central moving element moves from the extended position to the retracted position.

Aptly, the buffering means comprises a buffering chamber, configured to house a buffering fluid, wherein the volume of the buffering chamber decreases as the central moving element moves from the extended position to the retracted position.

Aptly, the buffering means comprises regulating means configured to regulate the internal buffering characteristics of the buffering means. Aptly, the regulating means is configured to control the amount of buffering fluid within the buffering chamber. By being able to regulate these characteristics, this configuration allows fine use of the dampening means during piling operations, while the buffer effect can be tailored to the specifics of the operation in situ and in real time.

Aptly, the actuating means is located intermediate the chamber and the at least a portion of the positioning element.

Aptly, the actuating means is located at an end of the chamber that is distal from the buffering means. In other words, the buffering means is located proximate a first side of the chamber and the actuating means is located proximate a second, opposing, side of the chamber. Aptly, the actuating means is coupled to an end of the guide element. Positioning the actuating means in this way allows easy access to the actuating means and also provides more space between the chamber and the plate element (for example for larger buffering means).

Aptly, the actuating means includes a clamp, configured to releasably clamp the chamber.

Aptly, the at least a portion of the positioning element is a plate element configured to overlay an upper surface of the pile. Aptly, the positioning element further comprises a sleeve element releasably connected to an upper portion of the pile.

Aptly, the guide element is configured to extend further through the channel as the chamber moves towards the pile.

Aptly, the chamber is filled with fluid via a conduit provided in the wall of the casing having a valve for controlling the fluid flow.

According to a third aspect of the present invention there is provided a method of driving a pile into ground, preferably offshore, comprising the following steps:

providing a pile, to be driven into the ground;

providing a pile driver assembly according to the first or second aspect of the present invention in a coaxial arrangement at or in the pile;

actuating the actuating means such that the chamber is moved away from the pile; and further actuating the actuating means to release the chamber such that the chamber displaces towards the pile and exerts a force on the positioning member, to controllably drive the pile into the ground.

The proposed method provides a simple and secure way of driving a pile into the ground, with maximum stability and balanced weight distribution throughout the entire piling operation.

Aptly, the method further comprises controllably buffering the force exerted by the chamber on the pile when the pile is controllably driven into the ground. This method step helps enable the assembly to perform the piling operation with a minimum underwater noise generation and therefore, underwater noise propagation.

Aptly, the method further comprises the steps of actuating and further actuating the actuating means until the pile is driven, into a pre-set position, into the ground.

Aptly, the method further comprises the step of substantially filling the chamber with a fluid. Aptly, the fluid is water from the offshore location.

As used herein, it is be understood that the terms 'upper', 'lower', 'upward', 'downward' and the like, in reference to the pile-driver assembly or a component thereof, refer to the orientation of the assembly or component when positioned on a pile, specifically on a vertically extending pile. It would be understood that prior to assembly/positioning of the pile-driver assembly or following position of the assembly in a non-vertical orientation such terms may be adjusted accordingly.

As used herein, it is to be understood that an 'extended' position and a 'retracted' position of a component are relative terms. That is, in an extended position a component has an increased length (i.e. an extended length) relative to the retracted position of a component. When referring to a component with a piston or piston-rod arrangement (or the like), in an extended position, the rod is further extended from the respective component in comparison to the retracted position of said component.

As used herein, it is to be understood that an 'amount of fluid' refers to a quantity of fluid without restriction on volume and pressure. For example, the 'amount of fluid' received within a chamber may be a fluid having a certain number of moles of said fluid. In general, this amount will have a corresponding to a volume for a given pressure. It would be understood that the volume and pressure of the fluid within the chamber within which it is received will depend on the volume of the chamber at any given moment (the volume may be variable).

As used herein, it is to be understood that a 'buffering fluid' refers to a fluid that is suitable for use in a buffer/damper. In general, a 'buffering fluid' as used herein particularly refers to a gas, the gaseous state allowing compression thereof to assist in buffering/damping.

BRIEF DESCRIPTION OF THE DRAWINGS

Embodiments will now be described by way of example only with reference to the accompanying drawings in which.

DETAILED DESCRIPTION OF THE INVENTION

Figure 1:
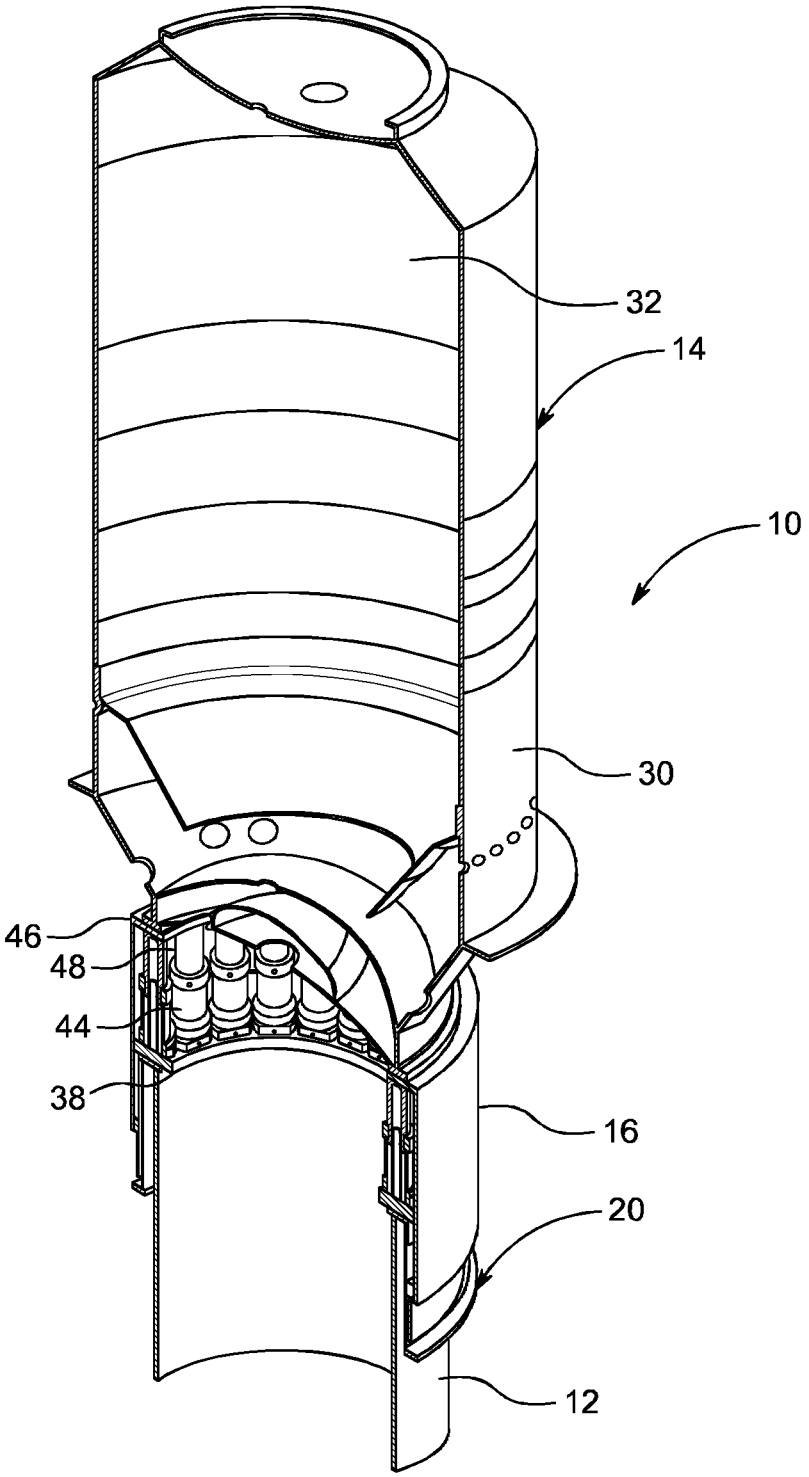
FIG. 1 is a vertical cross-sectional perspective view of an example of a pile-driver assembly.
Figure 2:
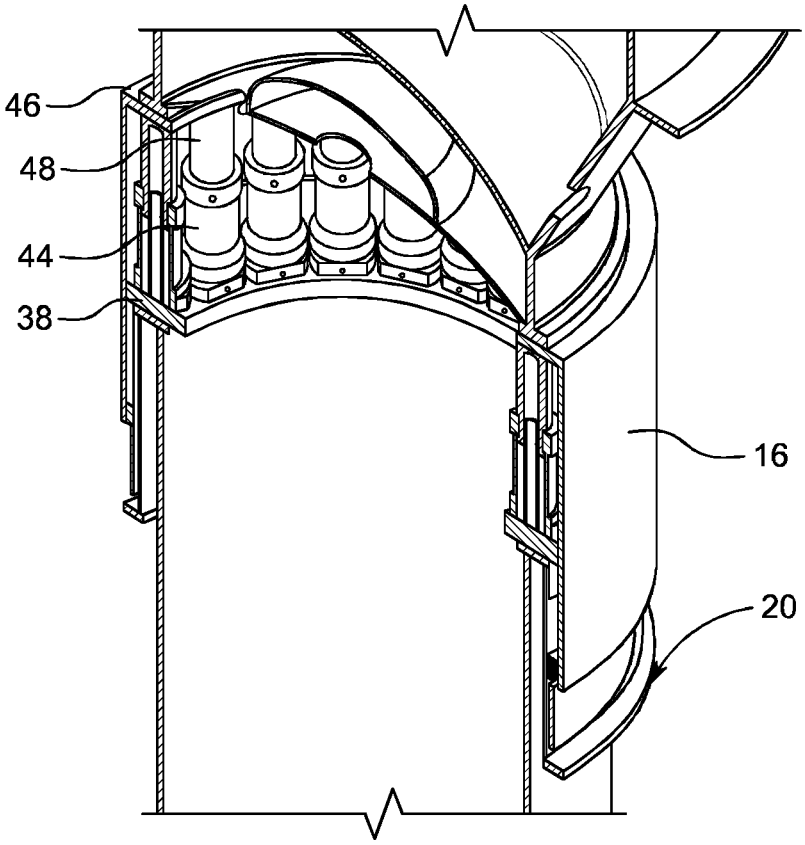
FIG. 2 to 5 are detailed vertical cross-sectional perspective views of the pile-driver assembly of FIG. 1.
Figure 3:
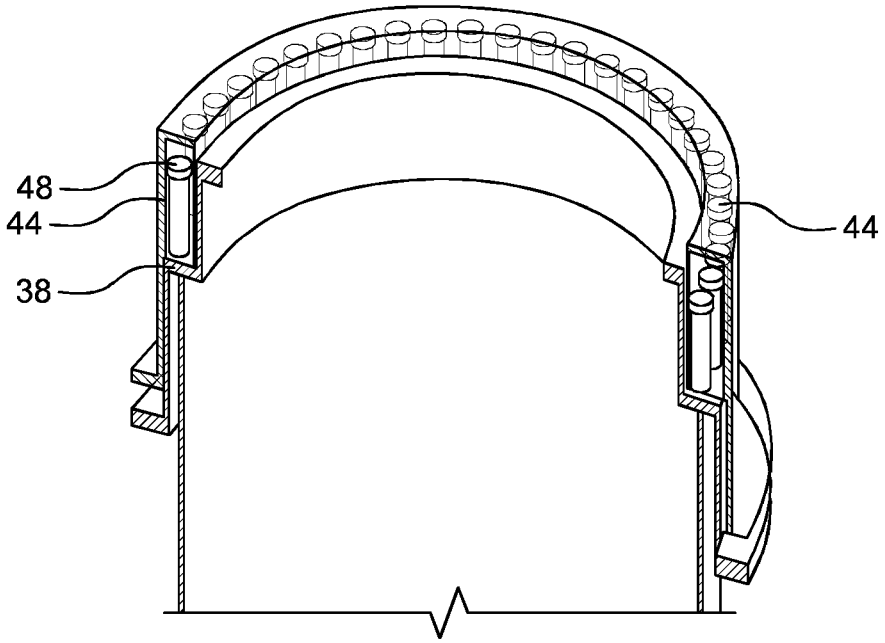
Figure 4:
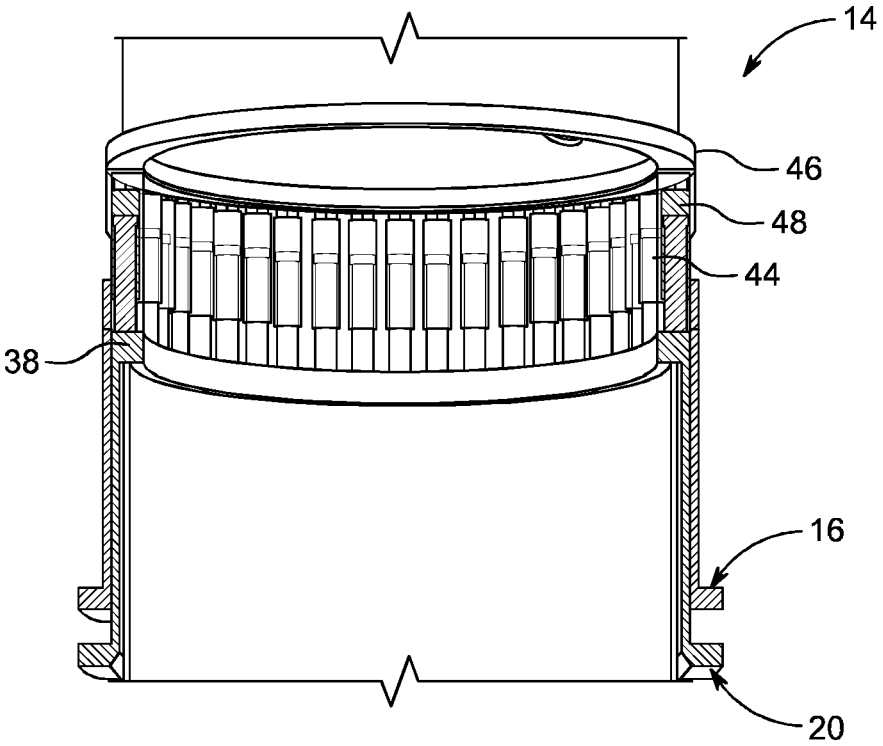
Figure 5:
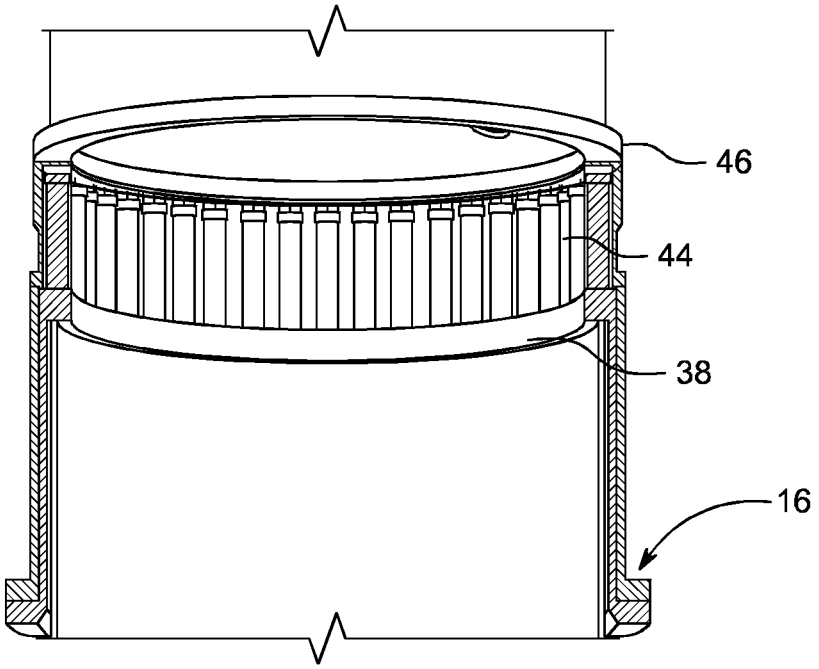

FIGS. 1 to 5 illustrate an example of a pile-driver assembly 10 for driving a pile 12 into the ground. The pile-driver assembly 10 includes a casing 14 defining a chamber 32. That is, the casing 14 comprises an interior volume (i.e. chamber 32) defined by an outer wall 30. In this example, the casing 14 is substantially cylindrical (i.e. the outer wall 30 of casing 14 is substantially cylindrical). The cylindrical shape of the casing enables easy transportation of the assembly. In addition, the cylindrical shape allows for a good load transfer of the pressure that builds up inside the casing. The internal pressure during impact results in a hoop stress in the wall of the casing. However in other examples casings of different shapes may be used.

The chamber 32 is configured to house a fluid, for example water. In other words, the chamber provides a generally sealed space configured to house and maintain a volume of fluid therein. The casing 14 may include a valve in a wall thereof, coupled to a fluid source/reservoir (for example via a pipe or conduit) to allow the chamber 32 to be filled before or during use. In this manner the assembly may be transported to the operation site with an empty chamber. The chamber 32 may then be filled up to a desired level in situ (either prior to lifting the chamber 32 or when lifted and when waiting for release). It would be understood that the 'desired level' may be predetermined to produce a predetermined impact energy for driving a pile into the ground. The water used to fill the chamber 32 may be water pumped from the offshore location, for example sea-water.

In this example, the chamber 32 has a volume capable of holding from about 1000 to 5000 tons of water. Chambers 32 of this volume are generally suitable for driving monopiles of a diameter of from about 6 to 15 meters into the ground. When the chamber 32 is filled with water, the total mass of the casing 14 (including the water therein) may be at least 8 times larger than the mass of a typical driven hammer used for piling operations (aptly around 8 to 12 times larger). For example, the mass of a large hydraulic impact hammer may be from about 200 to 270 tons, whereas the total mass of a casing 14 with water therein may be approximately 2700 tons.

The pile-driver assembly 10 further includes a positioning element configured to position the casing 14 at or on the pile 12. The positioning element includes a portion positioned between the chamber 32 and the pile 12. In this example, this portion is a plate element 38 configured to overlay an upper surface of the pile 12. The plate element 38 may be any suitable shape according to the cross-sectional shape of the pile 12. For example the plate element 38 may be circular (corresponding to a cylindrical pile). In the illustrated example, the plate element 38 is annular in profile, corresponding to the cylindrical/tubular pile 12.

In this example, the positioning element further comprises a sleeve element 20 releasably connected to an upper portion of the pile 12. In other words the sleeve element is configured to surround an upper portion of the pile 12. In this example, the sleeve element 20 is cylindrical/tubular in profile to correspond with the cylindrical/tubular pile 12.

In this example, the plate element 38 is provided at an end (specifically an axial end) of the sleeve element 20. The plate element 38 may be positioned on top of the cylindrical wall of the sleeve element 20 or attached or coupled at its outer edge, or at a position proximate thereto, to an upper surface of the sleeve element 20. In this way, when positioned on a pile 12, the plate element 38 is configured to sit on an upper surface of the pile 12, with the sleeve element 20 projecting downwardly therefrom. In examples, the sleeve element 20 and plate element 38 may be formed as a single integral component, or alternatively the plate element 38 may be coupled to the sleeve element 20, for example by welding or adhesive.

In this example, the positioning element is provided at least partially at an end of the casing 14. That is, the positioning element is at least partially positioned adjacent to or coupled to an end of the casing 14, in particular a lower end of the casing when the assembly is positioned on a pile 12. In this example, the plate element 38 and sleeve element 20 are both positioned at the lower end of the casing 14. This close positioning, allows fine alignment of the assembly during the piling operation.

In this example, the casing 14 includes a sleeve portion 16 at an end thereof. The sleeve portion 16 is configured to at least partially surround the sleeve element 20 of the positioning element to provide alignment between the positioning element and the casing 14. In other words, the sleeve portion 16 of the casing 14 is configured to extend over and at least partially overlap the sleeve element 20 of the positioning element. In this manner, during a piling operation (when the casing 14 moves relative to the positioning element), the sleeve portion 16 ensures the casing remains axially aligned with the pile. The arrangement thereby remains stable during piling operations. The sleeve portion 16 may have a length determined to ensure at least some degree of overlap with the sleeve element 20 at each stage of the piling operation, regardless of axial separation between the chamber 32 and the pile 12.

The pile-driver assembly 10 further includes actuating means. In this example, the actuating means comprises at least one actuator 44, or for the illustrated example a plurality of actuators 44, for example a hydraulic or pneumatic actuator.

In this example, the actuators 44 are located intermediate (i.e. between) the chamber 32 and the plate element 38. In other words, a space (or area of separation) is provided between a lower portion of the chamber 32 and the plate element 38, in which the actuators 44 are located.

In use, the pile-driver assembly 10 is positioned on a pile 12 to be driven into the ground. The piles 12 may be on or offshore. In general, the piles 12 extend substantially vertically from the ground, although the piles may deviate from a vertical arrangement.

The pile-driver assembly 10 is positioned on the pile 12 in a coaxial arrangement. That is, when positioned on the pile 12, the casing 14 is configured to extend from the pile 12 following the longitudinal axis of the pile 12. For example, for a vertical pile, the axis of the chamber (for example the longitudinal axis of the substantially cylindrical chamber) will extend vertically from the axis of the pile 12.

In some examples, the chamber 32 may have a channel extending therethrough. The channel may be an axial channel, for example extending along a substantially vertically extending longitudinal axis of the chamber 32. The channel may provide a pathway for deployment of a tool (for example a drill, waterjet or the like) therethrough. When the axial channel is positioned substantially coaxially with the axis of a hollow pile, the tool can access and work the soil directly beneath the pile to reduce resistance of the soil plug.

In this example, the actuators 44 are positioned on the plate element 38 in a position that corresponds to a wall of the pile. In other words, the actuators 44 are aligned with the axially extending wall of the pile. For example, in the illustrated pile-driver assembly, the actuators 44 are positioned around the circumference/periphery of the annular plate element 38 so as to correspond with the circumference of the cylindrical pile 12. In this way during the piling operation the force applied by the casing/chamber acts directly on the pile (through the actuators), thus minimizing the stresses on the pile.

Any suitable number of actuators 44 may be used, according to the specification of the actuator 44 and the mass to be lifted. In this example, actuators 44 are positioned around the entire periphery of the plate element 38 (corresponding to the wall of the pile 12) to ensure homogeneous lifting of the casing 14. However in other examples, fewer actuators 44 may be used, equally spaced around the periphery.

Following positioning of the pile-driver assembly 10 on the pile 12, the actuators 44 are actuated such that the chamber 32 is moved away from the pile 12. In other words, actuation of the actuating means displaces the chamber 32 relative to the positioning element, such that the chamber 32 moves away from the pile 12. The entire chamber is moved upwardly away from the pile.

Actuation of the actuators 44 may be provided in any suitable way (corresponding to the type of actuator 44 being used), for example actuation may be provided through hydraulic or pneumatic pressure according to the type of actuator 44 used. The chamber 32 may be displaced until it reaches a predetermined distance from the pile (for example corresponding to a position in which the chamber 32 has a predetermined potential/impact energy suitable for driving the pile into the ground.

The actuators 44 are then further actuated to release the chamber 32 such that the chamber 32 displaces towards the pile 12. That is, in this example, the chamber 32 is released so as to fall downwardly towards the pile 12. In releasing the chamber, the actuators 44 allow the chamber to fall towards the pile 12 as a result of gravity only (i.e. without an additional driving force).

The chamber 32 may be released by at least partially retracting the actuators 44, for example by at least partially removing the actuating pressure within each actuator 44 (i.e. the hydraulic or pneumatic pressure) to leave the chamber 32 unsupported. In other examples, the positioning element or actuating means may include locking means configured to lock the chamber 32 at the predetermined height. Once locked, the actuating means may be retracted before the chamber is 'unlocked' and released.

Following release, the chamber falls and exerts a force (specifically a downward force) on the positioning member. In this example, the force is exerted on the positioning member via the actuators 44. In some examples, following full retraction of the actuators 44, the chamber 32 falls (through the space inhabited by the actuators 44) and impacts the actuators 44. Alternatively, the chamber 32 falls as the actuators are retracted and impacts the actuators 44 as the actuators reach full retraction. The force of the impact is transferred from the actuators 44 to the plate element 38 and through the plate element 38 to the pile 12.

The above described arrangement is advantageous in that a larger mass (in this example a large chamber of water) is dropped on the pile 12, rather than a smaller hammer being driven to impact the pile 12. As such, the force from the large mass 'pushes' the pile into the ground, creating less noise and inflicting lower stresses on the pile compared to assemblies which utilise the impact of the ram of a hammer. In conventional hammer arrangements the actuators are used to drive the hammer towards the centre pile via an anvil, which distributes the force to the pile. For larger piles, a larger anvil is required to distribute the applied force. In the above described arrangement, the transfer of force through the actuators and positioning element to the pile removes the need for an anvil and is therefore better suited for larger piles.

In this example, the casing 14 includes an impact surface 46, configured to impact with the actuators 44 following release of the chamber. In this example, the impact surface 46 is an annular surface corresponding to the positioning of the actuators 44. As such, the force exerted by the casing 14 is focused on the actuators 44, resulting in a more efficient transfer of energy to the actuators (and subsequently the pile).

In this example, the assembly 10 further comprises buffering means for controllably buffering the force exerted by the chamber 32 on the pile 12 when the pile is driven into the ground. The provision of buffering means helps control the force exerted by the casing/chamber on the pile 12 when driving the pile into the ground. This allows the peak force to be controlled (for example lowered to reduce underwater noise) by buffering the applied force over a longer period of time. Any suitable buffering means may be used, for example the buffering means may include at least one buffering element.

Figure 6:
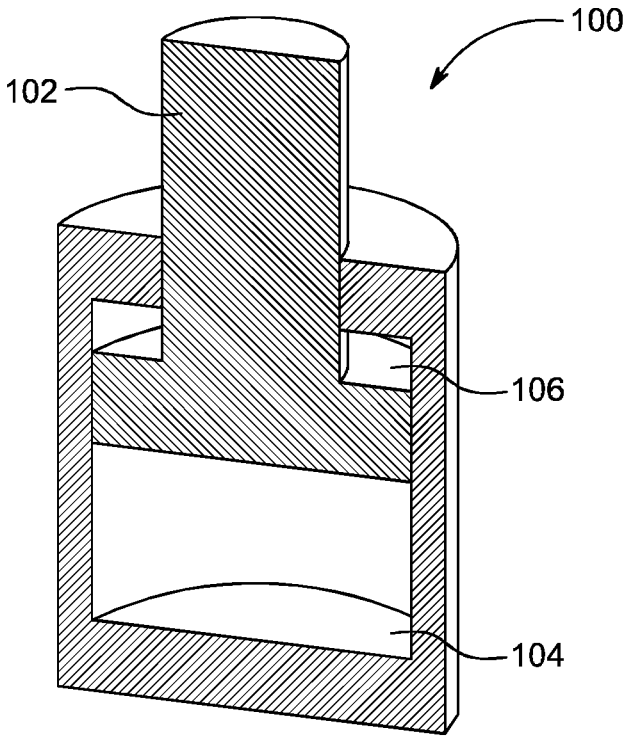
FIG. 6 is an example of a buffer element for the pile driver assembly of FIGS. 1 to 5.

An example of a buffering element 100 is illustrated in FIG. 6. The buffering elements 100 may be located in any suitable location. For example, the buffering elements 100 may be located adjacent to the actuators 44 (for example radially inwardly or outwardly of the actuators 44) or between spaced actuators 44. As the chamber 32 is released, the actuators 44 may be retracted past an upper end of the buffering elements 100, such that the chamber 32 impacts the buffering elements 100 as opposed to the actuators 44. In the same manner as described previously for actuators 44, the buffering elements 100 may be located in a position that corresponds to a wall of the pile for efficient transfer of force.

The buffering element 100 includes a central moving element, in this example a piston and rod arrangement 102. In this example, the buffering element 100 has a piston with diameter of from about 500 mm to 1200 mm and a rod of diameter of from about 200 mm to 700 mm, although any suitably dimensioned buffering element may be used in accordance with the required damping characteristics.

The piston and rod arrangement 102 has an extended position and a retracted position with the buffering element 100 being configured to buffer the downward force exerted by the chamber 32 on the positioning member as the piston and rod arrangement 102 moves from the extended position to the retracted position. In this example, the buffering element 100 includes a buffering chamber 104, configured to house a buffering fluid (for example a gas, such as nitrogen). As the piston and rod arrangement 102 moves from the extended position to the retracted position the volume of the buffering chamber 104 decreases and the fluid therein is compressed. This acts to decelerate (and eventually stop) the piston and hence also the chamber 32, which is driving the piston and rod arrangement 102 towards its retracted position.

The buffering characteristics of the buffering elements 100 may be set before use (or adjusted between impacts) in accordance with the required level of damping/buffering. For example the amount of fluid in the buffering chamber 104 may be set to optimise the impact signature (that is, the force-time, dF/dt, response) on the pile. In other words the buffering characteristics may be optimised so as to reduce the resultant noise/pile vibrations, while still providing the required driving performance. For example, the applied peak force following damping should reduce the peak force to thereby reduce vibrations and noise. However, the applied peak force following damping should still be sufficient to overcome the static soil resistance (which is typically in the range of hundred/s of meganewtons).

The choice of the buffering characteristics of each buffering element may depend on the impact energy of the chamber 32 and/or the number of buffering elements 100 used and/or the size of the pile 12 to be driven into the ground and/or the preferred number of 'drops' of the chamber 32 required to drive the pile 12 into the ground and/or the anticipated static soil resistance.

In this example, the buffering elements 100 include a further buffering chamber 106, configured to house a buffering fluid. The buffering chambers 104, 106 are separated (and sealed from one another) by the piston. The amount of fluid in each buffering chamber 104, 106 (and hence the relative pressure therebetween) may be controlled to control the buffering characteristics of the buffering elements 100. In other words, each buffering element 100 has an equilibrium state (that is, a state where the piston is static as a result of the opposing forces acting on the piston cancelling out). The amount of fluid in each buffering chamber 104, 106 may be set so that the buffer elements 100 is pre-tensioned and therefore prevents a hard impact of the chamber 32 against the pile.

The buffering elements 100 may include regulating means configured to regulate the internal buffering characteristics of the buffering elements 100. For example, the buffering elements 100 may control one or more valves, configured to control the amount of fluid, or the pressure of the fluid within at least one of the buffering chambers 104, 106.

As an example, in an equilibrium state the buffering chambers 104, 106 of a buffering element 100 may have an initial pressure of from about 60 bar to 140 bar. The peak pressure in the buffering chamber 104 may reach a peak pressure of from about 100 bar to about 600 bar during buffering of the force applied by the chamber on the pile.

The equilibrium state of the buffering element 100 at an initial stage of a piling operation may include the weight of the chamber (with or without water therein). That is, the buffering chambers 104, 106 of each buffering element 100 may be pressurised until the pressure in the buffering chambers 104, 106 is such that the weight of the chamber is supported by the buffering elements 100 (i.e. the chamber 32 is lifted slightly by the buffering elements 100). Upon actuation of the actuation means, the actuators 44 take the weight of the chamber 32 from the buffering elements 100. In doing so the piston of each buffering element will find a new equilibrium position.

The impact of the chamber 32 on the piston and rod arrangement 102 may compress the fluid in the buffering chamber 104 (of each buffering element 100) until the pressure therein is greater than the weight of the chamber. In this situation the chamber may 'bounce'—that is, once the piston has reached its retracted position, the piston will begin moving at least partially towards its extended position. The buffering fluid in the further buffering chamber 106 is then compressed to decelerate the upward movement of the piston. In some examples, the actuators 44 may be actuated to further lift the chamber 32 (to begin another stroke) when the chamber 32 is at the top of its bounce. In doing so, the energy input required to then return the chamber to its elevated position from the semi-extended position is reduced. In other words, a spring effect is provided by the buffering chambers 104, 106 of each buffering element 100, such that when the casing is controllably released, to drive the pile into the ground, the elasticity of the buffering means allows a better distribution of the downward force, while the underwater noise is significantly reduced.

In the example illustrated in FIGS. 1 to 5, rather than including buffering elements 100 separate from the actuators 44, the buffering means is integral with the actuating means. That is, each actuator 44 also functions to buffer the force exerted by the chamber 32 on the pile 12 when the pile is driven into the ground. As such, when referring to the example illustrated in FIGS. 1 to 5, the terms 'actuating means' and 'buffering means' may generally be used interchangeably.

Figure 7:
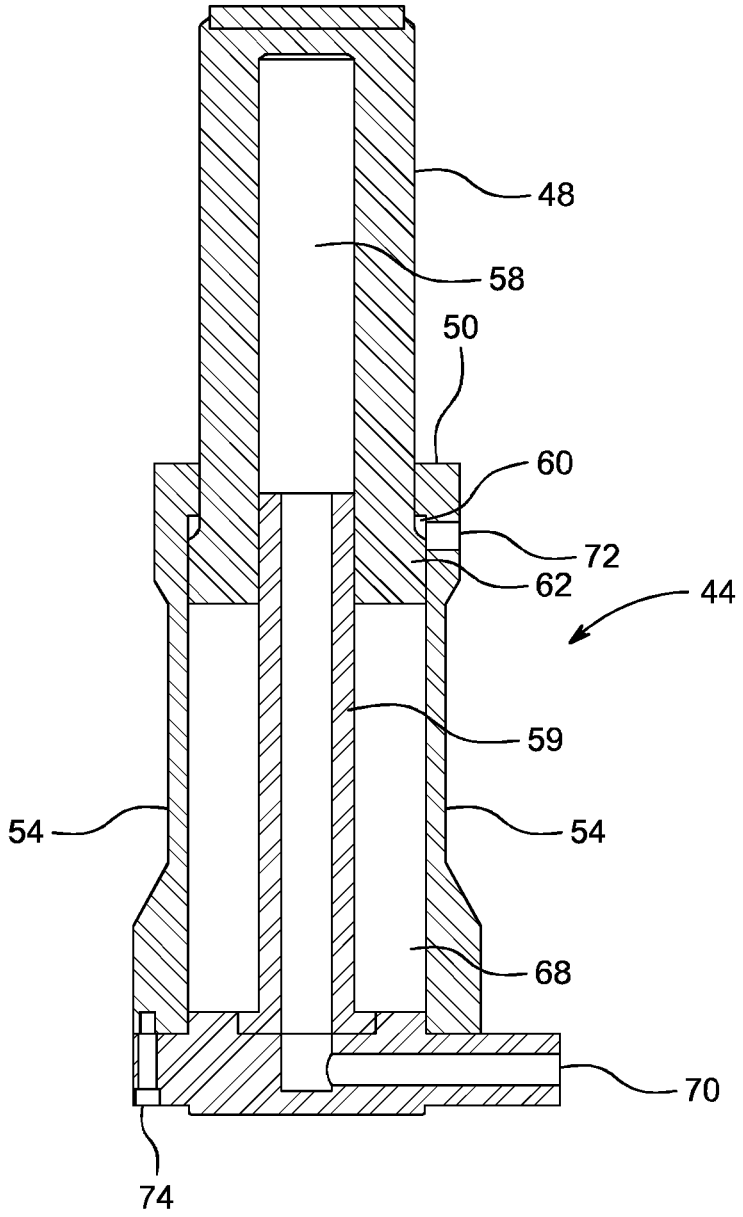
FIG. 7 is a detailed vertical cross-sectional view of an example of an actuator for the pile driver assembly of FIGS. 1 to 5.

FIG. 7 illustrates a cross-section of an actuator 44 (with integrated buffering functionality) of this example. The actuator 44 includes a central moving element, i.e. piston 48, having an extended position and a retracted position. The actuator 44 includes a fluid chamber (or fluid volume) 58, configured to house a fluid, for example a suitable hydraulic fluid such as oil. During use, an increase in the amount of oil within the fluid chamber 58 causes the central moving element 48 to move from the retracted position towards the extended position (i.e. causes the actuating 44 to actuate).

In this example, the piston 48 is elongate and at least partially housed within actuator housing 54. The piston 48 is movable within an actuator housing 54, but is prevented from separating from the actuator housing 54 through an engagement between a flange portion 62 of the piston 48 and a lip portion 50 of actuator housing 54.

In this example, the fluid chamber 58 is defined by a hollow space, extending axially within the piston 48. The fluid chamber 58 is configured to receive a conduit/channel 59, which fluidly couples the fluid chamber 58 to a fluid source/reservoir. In this example the conduit 59 extends upwardly from a position proximate the base of the actuator 44, the conduit 59 being substantially co-axial with the hollow space of the fluid chamber 58. With the piston 48 in a retracted position, the conduit 59 is configured to substantially fill the fluid chamber 58.

As oil is supplied to the fluid chamber 58 through the conduit 59, the pressure in the fluid chamber 58 increases. This causes the piston 48 to move relative to the conduit 59. Specifically the piston 48 slides axially along the conduit 59 thereby increasing the volume of the fluid chamber 58.

In this example, the actuator 44 includes a valve 70 configured to control the flow into or out of the fluid chamber 58. The valve 70 is fluidly coupled to the fluid chamber 58 via conduit 59.

In this example the actuator 44 further includes an additional fluid chamber 60 configured to house a fluid, for example a hydraulic fluid such as oil. In this example, the additional fluid chamber 60 is defined between an outer surface of the piston 48 and the inner surface of the actuator housing 54. The space between the piston 48 and the inner surface of the actuator housing 54 corresponding to fluid chamber 60.

In this example the actuator 44 includes a valve 72 configured to control the flow into or out of the fluid chamber 60. Although not shown in FIG. 7, in some examples the additional fluid chamber 60 is fluidly coupled to the first fluid chamber 58. That is, the valves 70 and 72 may be coupled by a conduit or pipe. In such examples, the fluid chamber 60 may serve to store fluid from the first chamber 58 when the piston 48 is in a retracted state (i.e. before actuation or between actuations). In other words, when both valves 70 and 72 are open (and the fluid chambers 58 and 60 are fluidly coupled by the valves 70, 72), oil may be allowed to pass between fluid chambers 58 and 60 as the piston is extended/retracted. In some examples, the maximum volume of fluid chamber 58 (achieved when the piston 48 is in its most extended position) is substantially equal to the maximum volume of fluid chamber 60 (achieved when the piston 48 is in its most retracted position).

In general (for example in a situation where the valve 74 is open), the central moving element is moved between the extended and retracted position depending on the fluid pressure of the fluid chambers. That is, if the pressure of oil in the fluid chamber 58 is higher than the pressure of fluid in the fluid chamber 60 (for example, due to impact of the chamber 32 on the piston 48) the piston 48 moves from the extended position to the retracted position (to reach equilibrium). As the piston moves, the fluid in chamber 58 is forced out to fluid chamber 60.

The amount of oil in each fluid chamber 58 and 60 may be determined to provide a particular equilibrium position of the piston 48 depending on the mass of the casing 32 and the expected force to be exerted on the pile 12. For example, the equilibrium position may correspond to the piston 48 being in a relatively extended position, to prevent a hard (and therefore loud) impact of the casing 32 against the pile 12.

The actuator 44 is configured to buffer the downward force exerted by the chamber 32 on the positioning member as the piston 48 moves from the extended position to the retracted position. In other words, the actuators 44 are configured such that the chamber is decelerated as the piston 48 of each actuator 44 is moved from an extended position to a retracted position.

In this example, the actuator 44 includes a buffering chamber 68, configured to house a buffering fluid, for example a gas such as nitrogen. In this example the buffering chamber 68 is defined between an outer surface of the conduit 59 and the inner surface of the actuator housing 54. In particular, the actuator housing 54 is separated into buffering chamber 68 and fluid chamber 60 by the flange portion 62 of the piston 48.

The volume of the buffering chamber 68 decreases as the piston 48 moves from the extended position to the retracted position. In particular, as the piston 48 slides over the conduit 59 towards a base of the actuator 44 the volume of the buffering chamber 68 decreases.

The buffering effect of the actuator 44 is provided by the buffering fluid in the buffering chamber 68. More specifically, as the piston 48 moves from the extended position to the retracted position the piston 48 compresses the gas in the buffering chamber 68, due to the decrease in volume of the buffering chamber 68. The resistance provided by the compression of the gas in the buffering chamber 68 acts to decelerate (and eventually stop) the piston 48 (and similarly the passage of oil from the fluid chamber 58 to the fluid chamber 60). Hence the chamber 32, which is driving the piston 48 towards its retracted position, is also decelerated and eventually stopped.

In this example, the actuator 44 includes regulating means configured to regulate the internal buffering characteristics of the actuating means. In particular, the actuator 44 includes a valve 74 configured to control the amount of gas in the buffering chamber (although valve 74 is not shown as being fluidly coupled to the buffering chamber 68 in FIG. 7). In doing so, the pressure in the buffering chamber 68 of each actuator 44 for a given load can be controlled. As such, the deceleration of the piston/chamber and as a result the force-time response, is also controlled.

In use, when using the actuator 44 as illustrated in FIG. 7, pressurised oil (for example pumped from a reservoir) is made available to the valve 70 in each actuator 44. Similarly, pressurised nitrogen is made available to the valve 74 of each actuator 44. The valve 70 is then opened to provide fluid to the fluid chamber 58, thereby actuating the piston 48 to lift the casing 14. Typical hydraulic pressures range may be from about 200 to 420 Bar.

As described previously, actuation of the actuators 44 acts to lift the chamber 32/casing 14. The valve 72 may be opened at this time so as to allow the piston 48 to move to its extended position without having to compress a fixed amount of oil in chamber 60. As such, as the piston moves to its extended position, the oil in the second chamber 60 is squeezed out by the flange portion 62 of the piston (in other words, the flange portion 62 progresses towards the lip portion 50 of actuator 44).

The valve 74 may also be opened at this time. Firstly, this allows the piston 48 to move to its extended position without being restricted by expanding a fixed amount gas (which may lead to a suction force due to a reduced pressure) in chamber 68. In addition, this allows a predetermined amount of buffering fluid to be provided into buffering chamber 68. The gas may be pumped in, or sucked in as a result of the increasing volume of buffering chamber 68. Typical peak pressures in the buffer chamber 68 may be from about 200 to 800 Bar.

As the actuator 44 reaches the intended extended position, the valves 70, 72, 74 of each actuator are then closed. In using a relatively incompressible hydraulic liquid in fluid chamber 58, closing the valves in this way acts to lock the piston in position.

Valves 70 and 72 of each actuator 44 may then be opened, so that fluid can flow from the first chamber 58 to the second chamber 60 of each actuator 44. This allows the weight of the casing 14, and the liquid therein, to urge the piston 48 to move downwardly. As the piston 48 is pushed downwardly, the piston 48 will urge oil from the first chamber 58 into the second chamber 60 via its second valve 72. At the same time, the piston 48 (or more particularly the flange portion 62 thereof) compresses the gas in the chamber 68. The resulting increase in gas pressure in the buffering chamber 68 will slow down and eventually stop the downward movement of the piston 48 and thereby the downward movement of the casing 14.

The force acting to push the piston 48 down is transferred to the pile 12 via the compressed gas. The compression of the gas acts to alter the force-time response; stretching out the time duration of force application to the pile 12, such that the peak force is reduced. In a similar manner as described above for the buffering element 100 of FIG. 6, during compression of the gas, the pressure in the buffering chamber 68 may rise until the pressurised gas in the buffering chamber 68 applies an upward force on each piston 48 that exceeds the weight of the casing 14. As such, the piston 14, and chamber 32, will be urged upwardly. This bounce/rebound can cause oil to be pressed out of the second chamber 60 of each actuator 44 and to flow back to its first chamber 58.

In some examples, during this rebound, the second valve 72 of each actuator 44 is preferably switched from an open position to a check valve position. This allows oil to flow from the second chamber 60 of each actuator 44 back to the first chamber 58 during any upward movement of the casing but blocks oil flow in the opposite direction. As a result, if the casing 14 starts accelerating downwardly again, oil pressure will build up in the first chamber 58 in each actuator. This will restrain the casing 14 from further movement. The pile-driver assembly 10 is then ready for the next stroke. In other words, the actuator 44 can be locked in a (semi) extended position; that is, at the top of a 'bounce'. In doing, the energy input required to then return the chamber 32 to its elevated position from the semi-extended position is reduced.

The actuators 44 may then be repeatedly actuated until the pile 12 is driven, into a pre-set position, into the ground.

FIGS. 8 to 14 illustrate another example of a pile-driver assembly 110. This example includes generally corresponding features to that of the previous example, with such features being labelled in the same way. For brevity, like features from the previous example will generally not be described again.

As per the previous example, the pile-driver assembly 110 includes buffering means for controllably buffering the force exerted by the chamber 32 on the pile 12 when the pile 12 is driven into the ground. In this example, the buffering means includes a plurality of buffering elements 100, of the type illustrated in FIG. 6. In this example, the buffering means are separate (i.e. not integral) with the actuating means. In other words, the pile-driver assembly 110 includes actuators 144 separate from the buffering elements 100. However, in variants of this example the pile-driver assembly 110 may include actuators 44 which also provide a buffering function, such as that illustrated in FIG. 7.

Figure 8:
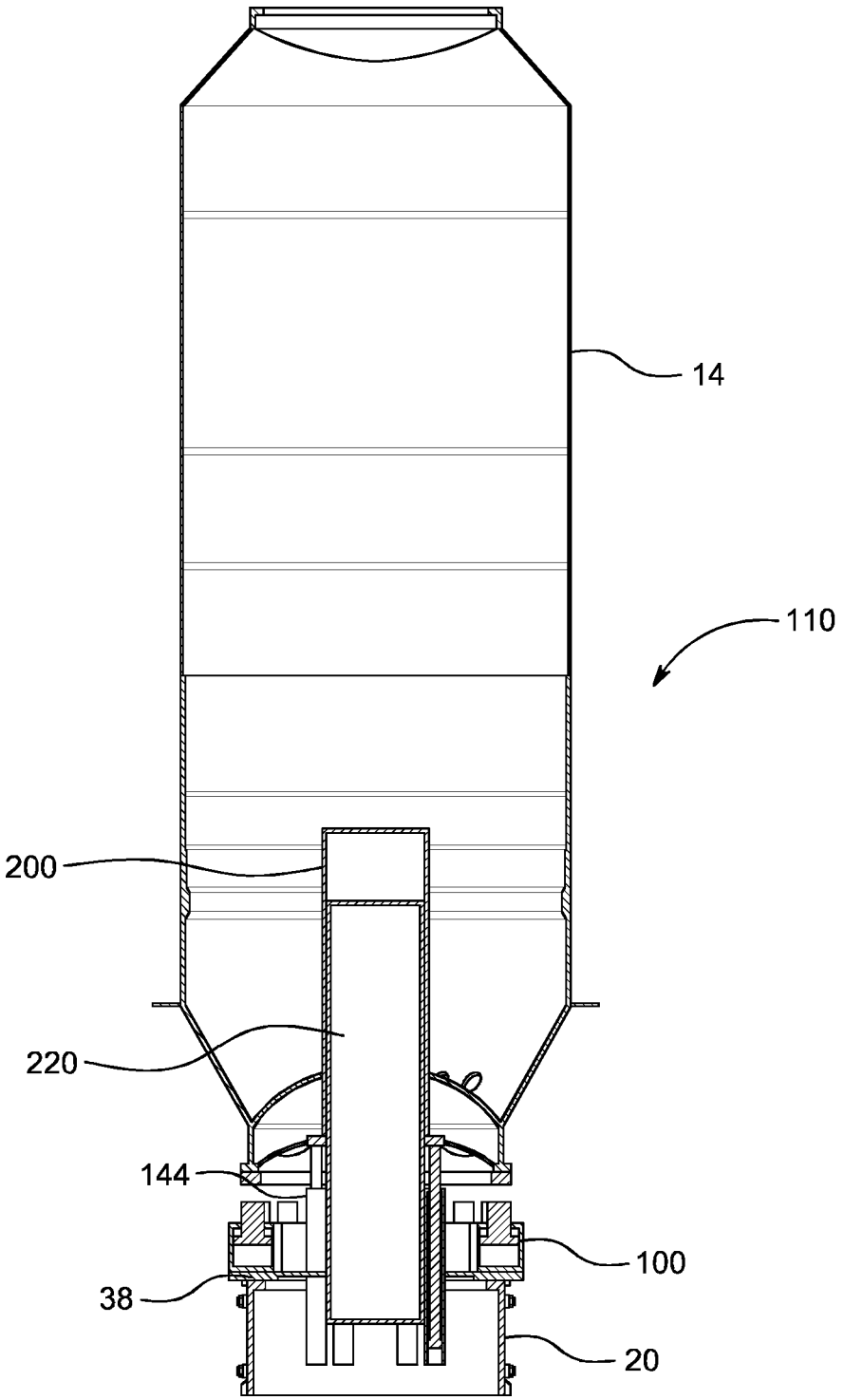
FIGS. 8 and 9 illustrate cross-sectional views of another example of a pile-driver assembly.
Figure 9:
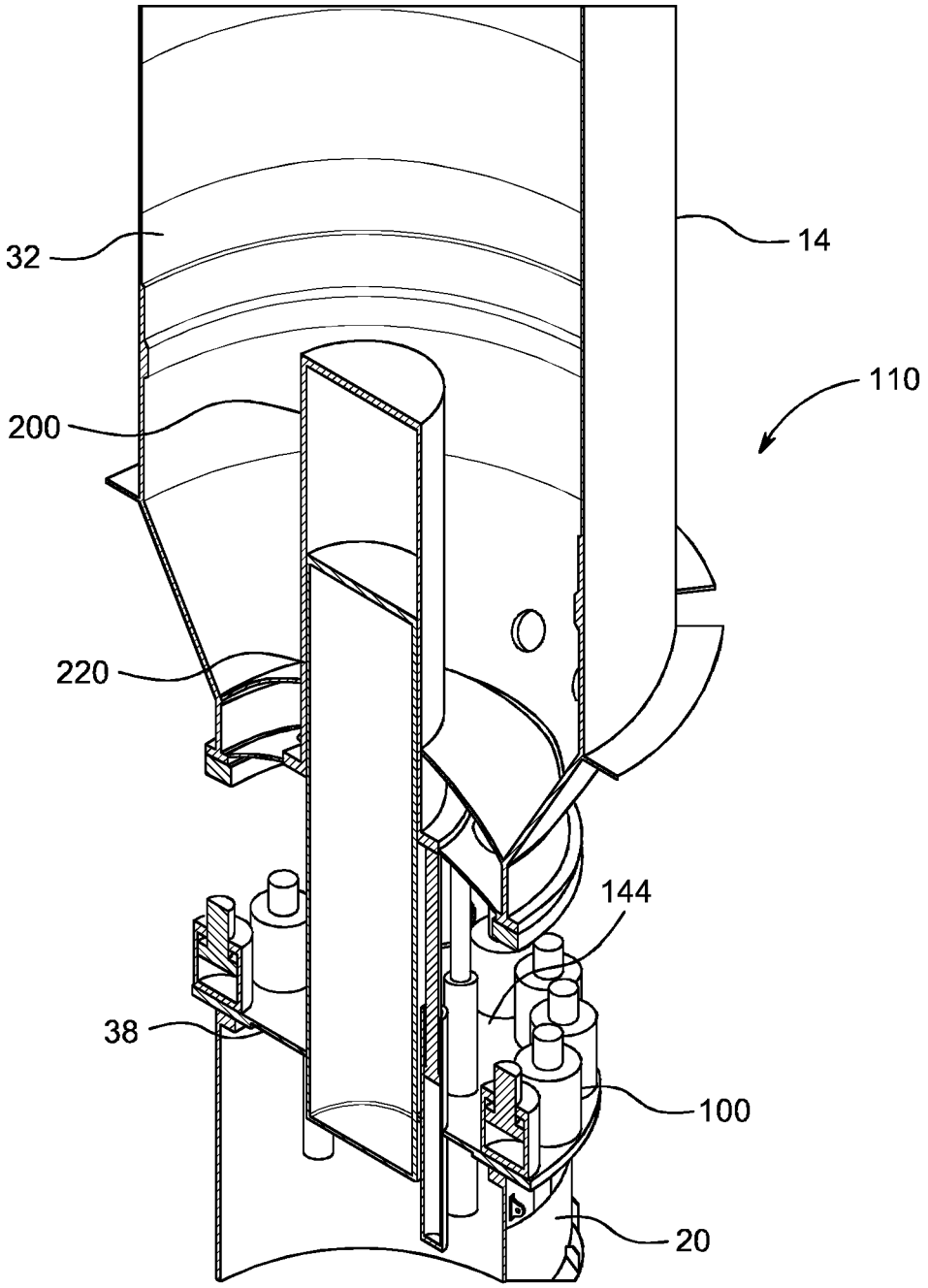

As shown best in FIGS. 8 and 9, the buffering elements 100 and the actuators 144 are located intermediate (i.e. between) the chamber and the positioning element. In this example, the buffering elements 100 are positioned on the plate element 38 in a position that corresponds to a wall of the pile. The actuators 144 are positioned radially inwardly of the buffering elements 100.

In this example the chamber includes a channel 200 extending axially partially through the chamber. In this example, the channel 200 extends through a lower portion of the chamber 32. That is, the casing 14 includes a recessed channel 200 in an outer surface thereof, in particular a lower surface. In other words, the channel extends upwardly (towards the interior of the chamber 32) from a lower surface, or base, of the casing and extends through at least a portion of the chamber 32.

In this example the positioning element comprises a guide element 220. In this example, the guide element 220 is a cylinder or columnar structure.

In this example, the guide element 220 extends through the plate element 38. That is, the guide element 220 extends from a first side of the plate element 38 to a second side of the plate element 38. In other examples, the guide element 220 may extend from a surface of the plate element 38 only. For example, the guide element 220 may extend from the upper surface of the plate element 38.

The guide element 220 may be formed integrally with the plate element 38, are may be fixed to the plate element 38, for example by welding.

The guide element 220 is configured to extend at least partially through the channel 200 of the chamber 32. In other words, the guide element 220 is configured to mate or couple with the channel 200/the channel 200 is configured to receive the guide element 220.

Figure 10:
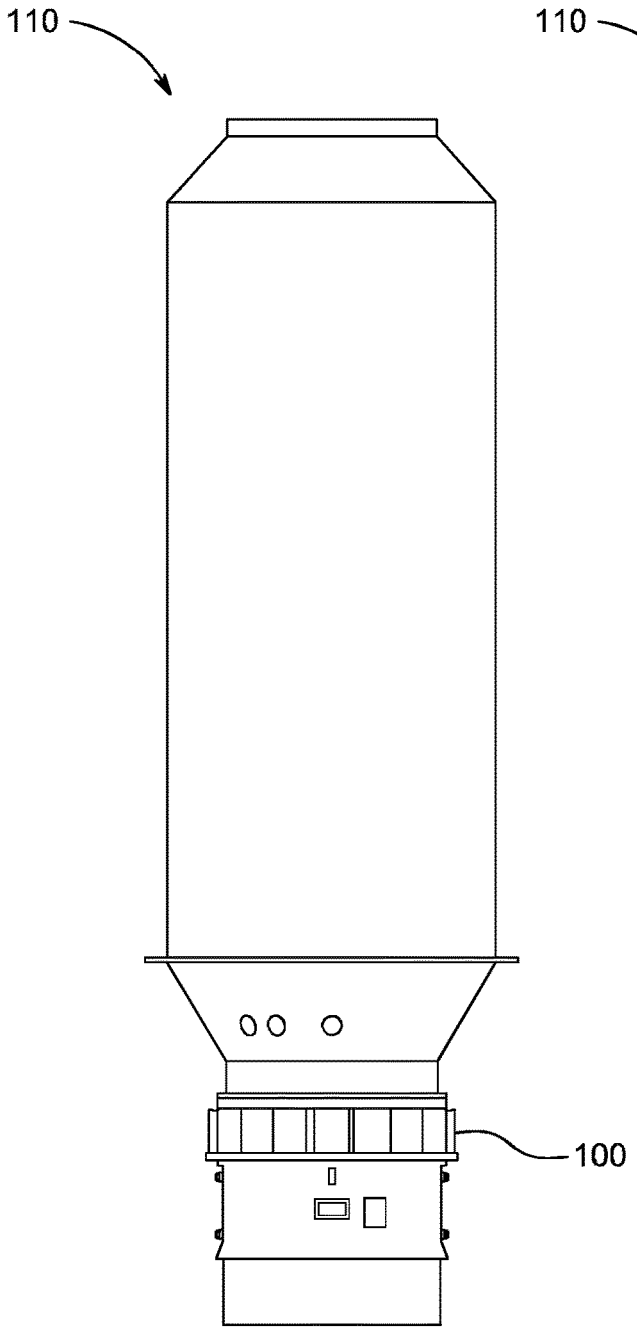
FIGS. 10 to 14 illustrate a side view of the pile-driver assembly of FIGS. 8 and 9 during stages of operation.
Figure 11:
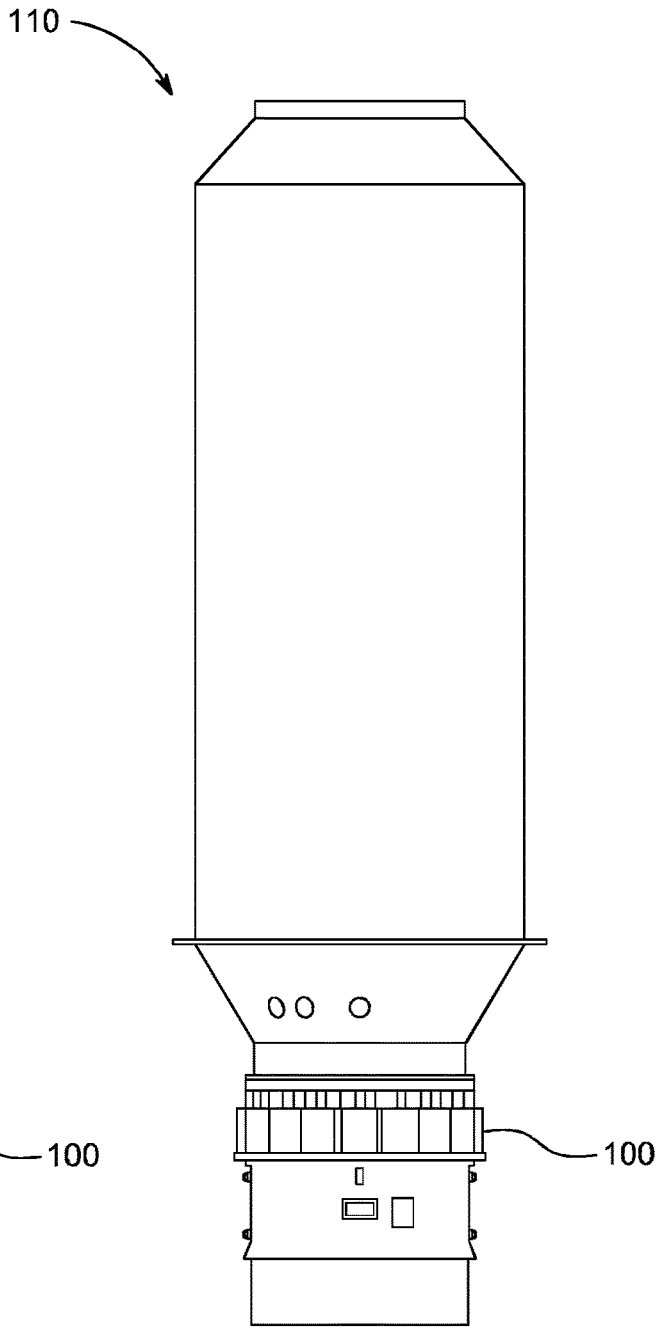
Figures 12, 13, 14:
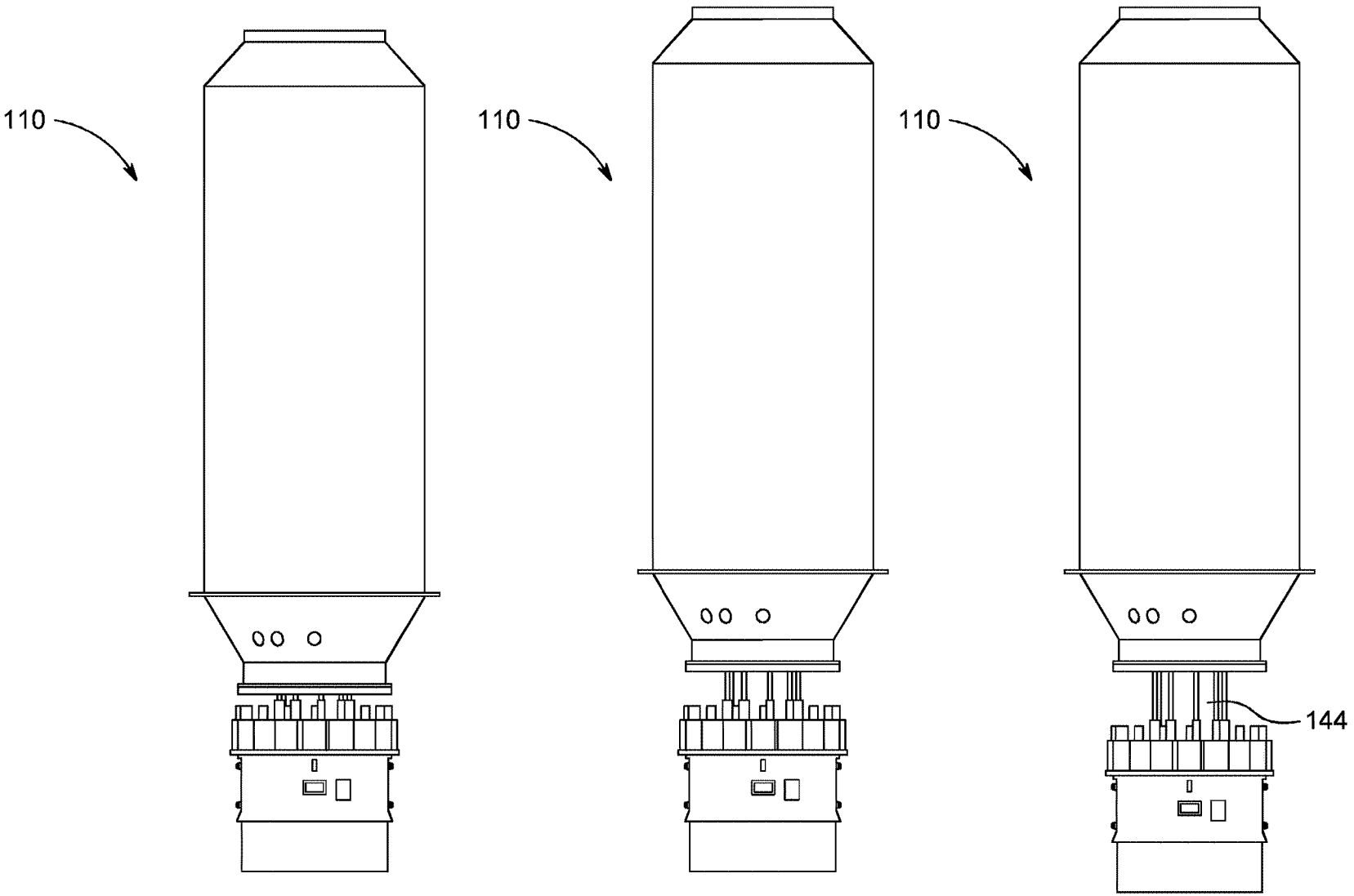

FIGS. 10 to 14 illustrate the pile-driver assembly 110 performing a pile driving operation. FIG. 10 illustrates the pile-driver assembly 110 in an initial, rest, position. The actuators 144 are retracted and the buffer elements 100 do not include a gas in the buffering chamber thereof. FIG. 11 illustrates the pile-driver assembly 110 in a stand-by position. That is, the buffering chamber of the buffer elements 100 have been at least partially filled with a gas, such that the chamber has been lifted slightly from its rest position. At this stage the system is ready for lifting. FIGS. 12 to 14 illustrate the pile-driver assembly during the lifting operation. In particular, FIGS. 12 to 14 illustrate the pile-driver assembly where the actuators 144 are in an increasingly extended position, lifting the chamber to an elevated position.

During the lifting/release operations, the chamber 32 moves relative to the positioning element. As such, the guide element 220 moves relative to the channel 200. That is, in this example the guide element 220 is configured to extend further through the channel 200 as the chamber 32 moves towards the pile. Similarly, the guide element 220 is configured to at partially retract from the channel 200 as the chamber 32 moves away from the pile.

In this example, the guide element 220 is configured such that a portion of the guide element 220 remains within the channel 200 during all lifting/release operations (i.e. the guide element 220 is configured to no more than partially retract). Specifically, the guide element 220 is sized so as to be longer than the maximum displacement of the chamber 32 from the plate element 38.

Providing a guide element 220 and channel 200 that interact in this manner is advantageous in helping maintain alignment between the casing 14/chamber 32 and the positioning element (and hence also the pile 12). In particular, the guide element has a fixed position and orientation with respect to the pile. By configuring the assembly such that the channel engages with the guide element throughout lift and release of the casing/chamber, the casing/chamber remains aligned with the pile and can hence provide a more consistently focused force on the file.

In this example, the guide element 220/channel 200 interaction is used instead of a sleeve assembly (that is, a sleeve element of the positioning element and a sleeve portion of the casing surrounding the sleeve element) to provide the consistent alignment. However, in some examples the assembly may include both a guide element/channel and a sleeve assembly.

The guide element 220 may extend fully through the chamber 32 to provide increased guidance and support to the chamber 32. In addition, the channel 200/guide element 220 may be any suitable shape. For example, both the channel 200 and guide element 220 may have a square, rectangular or I-shaped cross-section. To provide a tight fit, and hence increased stability, in some examples the cross-section of the guide element substantially corresponds to the cross-section of the channel.

Figure 15:
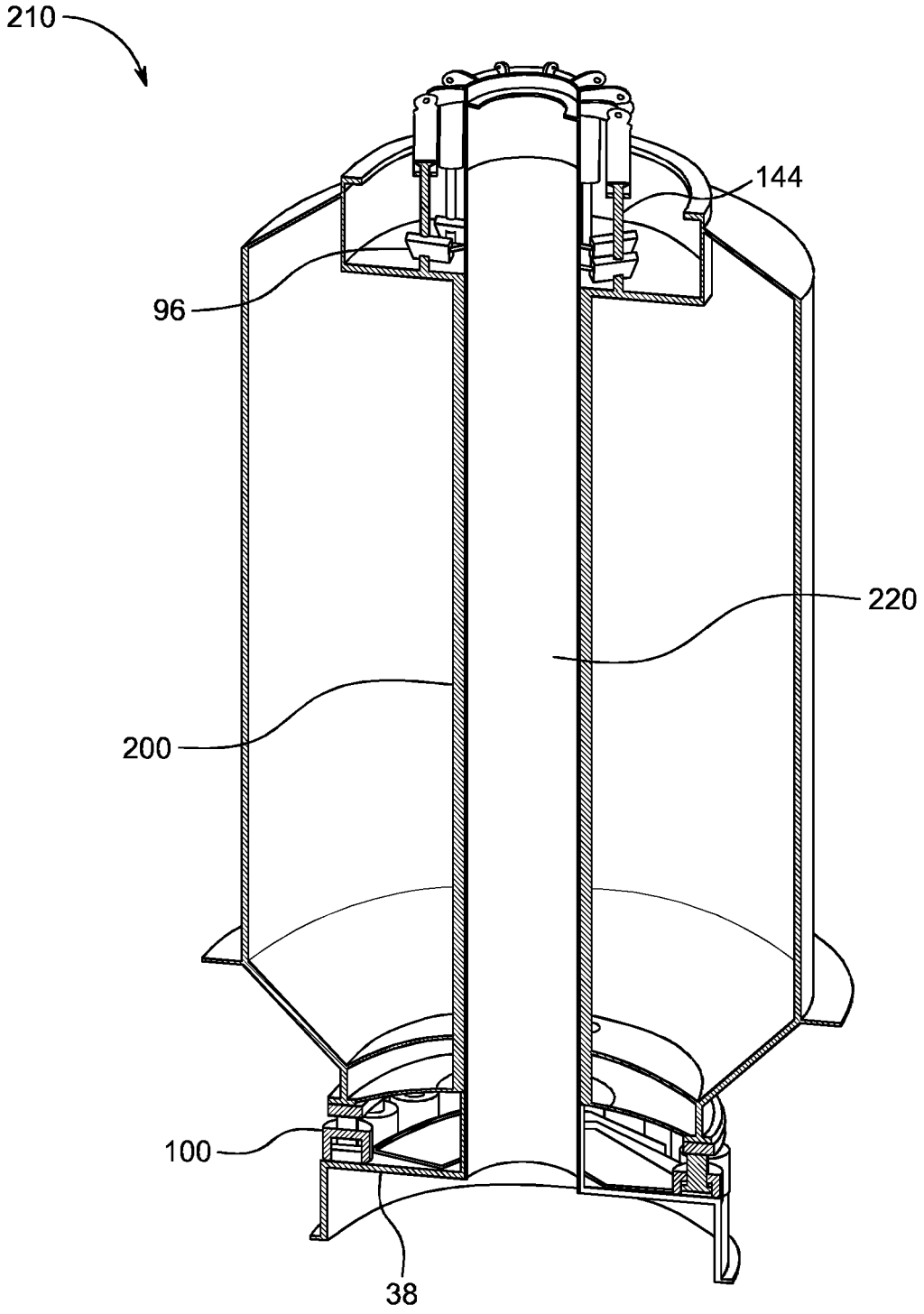
FIGS. 15 to 17 illustrate a vertical cross-sectional perspective view of another example of a pile-driver assembly during operation.
Figure 16:
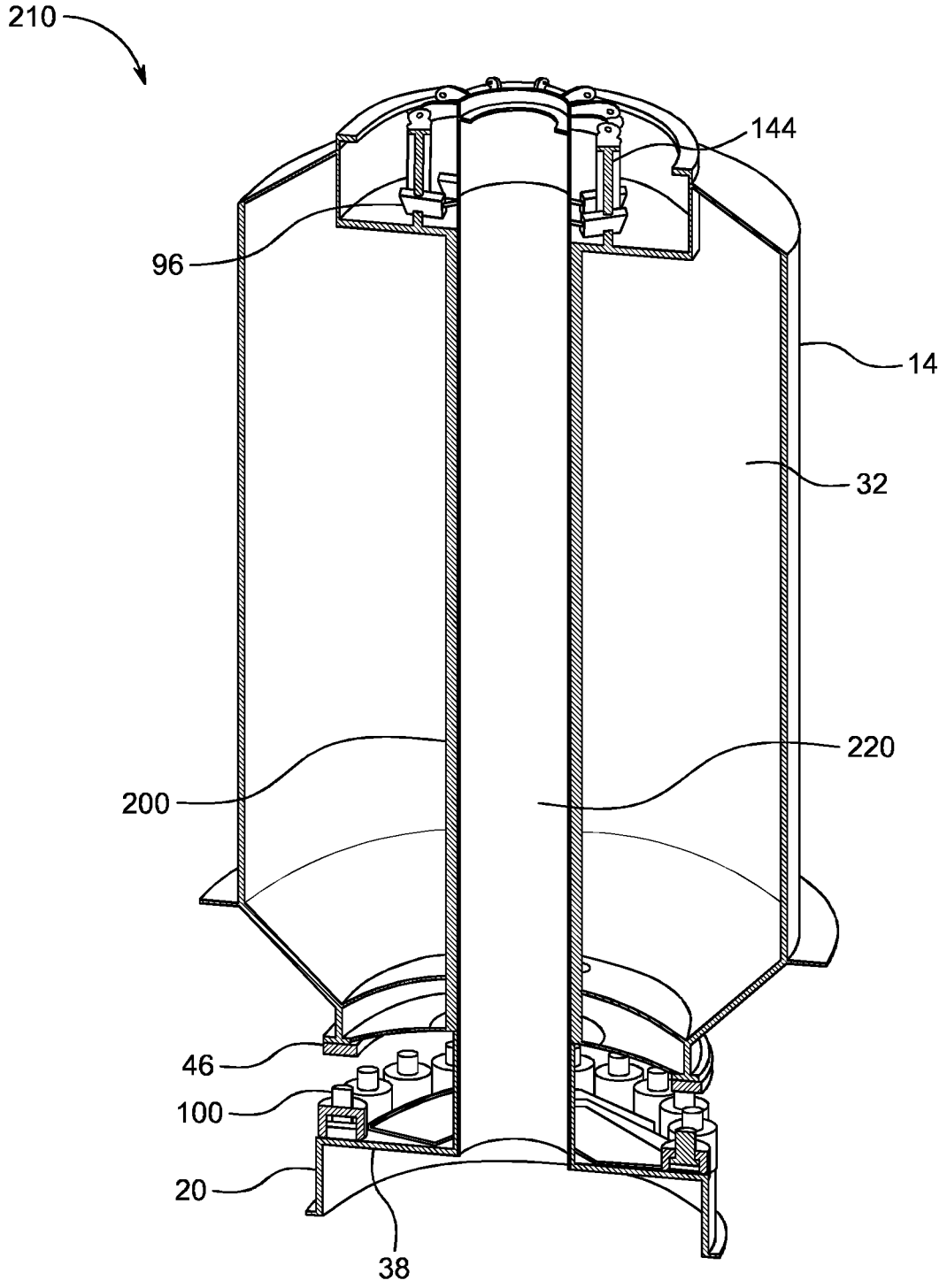
Figure 17:
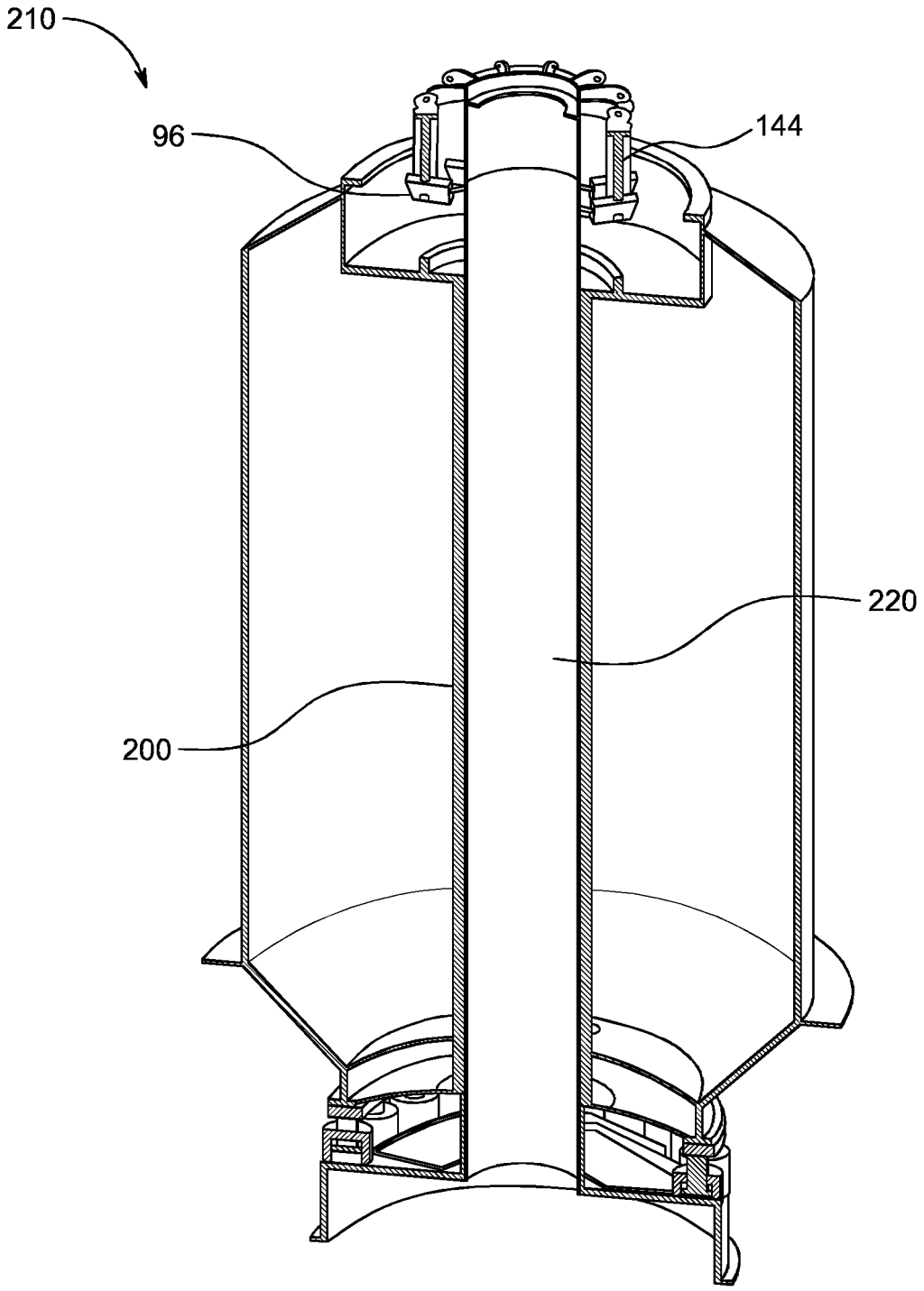

FIGS. 15 to 17 illustrate another example of a pile-driver assembly 210. This example comprises generally corresponding features to that of the previous example, with such features being labelled in the same way. For brevity, like features from the previous example will generally not be described again.

In a similar way to the previous example, the chamber 14 includes a channel 200 extending axially through the chamber 32. However, in this example, the channel 200 extends through the entire length of the chamber 32. In other words, the channel 200 extends between lower and upper surfaces of the chamber 32.

In a similar way to the previous example, the positioning element comprises a guide element 220, configured to extend at least partially through the channel of the chamber. In this example however, the guide element 220 extends through the entirely of the channel 200. That is, the guide element extends from the plate element 38, enters the channel on a first side of the chamber 32 and passes through the channel 200, emerging on an opposing side of the chamber 32.

In this example, the guide element 220 is tubular such that a passage is provided through the channel 200. As such, in the same manner as described previously, the guide element/channel provides a pathway for deployment of a tool (for example a drill, waterjet or the like) therethrough.

In this example, the actuators 144 are located at an end of the chamber 32 that is distal from the buffering elements 100. In other words, the buffering elements 100 are located intermediate the chamber (specifically a lower end thereof) and the plate element 38 of the positioning element and the actuators 144 are located proximate an upper end of the chamber 32.

The actuators 144 are coupled to an end of the guide element 220. Specifically, the guide element 220 has a lower end, coupled to or formed integrally with the plate element 38, and an upper end, configured to extend from the channel 200 above the chamber 32. The actuators 144 are coupled to the upper end of the guide element.

The actuators 144 may be coupled to the guide element 220 in any suitable manner. For example, the upper end of the guide element 220 may include an flange, extending radially outwardly. The actuators 144 may be coupled to the flange of the guide element 220. In other examples the actuators 144 may be coupled to the guide element 220 by a collar member or connecting member attached to an upper end of the guide element 220.

The actuators 144 couple the guide element 220 to the chamber 32. That is, the actuators 144 are coupled to both the guide element 220 and the chamber 32. In other words in this example, the guide element 220 acts as a stationary lifting point. In this example, the actuators 144 each include a clamp 96, configured to releasably clamp the chamber 32.

FIG. 15 illustrates the pile-driver assembly 220 in an initial position. In this example, the buffer elements 100 are pressurised to support the weight of the chamber 32. The actuators 144 are in an extended position and are coupled to an upper surface of the casing 32 via clamps 96. In other examples, the buffer elements 100 may only be pressurised once the weight of the chamber is taken by the actuators 144.

The actuators 144 are then actuated such that the chamber 32 is moved away from the pile. It would be understood that actuators 144 of piston/piston-rod type, as described previously, may be used, however in an 'inverted arrangement'. In this inverted arrangement, actuation of the actuating means causes the pistons thereof to move from the extended position to the retracted position. As the actuators retract, the chamber 32 is pulled upwardly towards the upper end of the guide element 220. The actuators are retracted until the chamber reaches a pre-determined elevation above the pile/positioning element.

The actuation means are then further actuated to release the chamber such that the chamber displaces towards the pile. In this example, the actuators are further actuated by releasing the clamps, to effectively drop the chamber. However, in other examples, the actuators may be further actuated by removing the pressurised fluid used to initially actuate the actuator (i.e. drive the chamber upwardly).

The actuators may then be actuated in an opposing direction to extend the central moving element of the actuator to return to the initial position of FIG. 15 and repeat the piling operation.

In any of the preceding examples, the positioning element remains static on top of the pile (that is, the positioning element acts as a static lifting point and there is no movement between the positioning element and the pile during operation). As such, the pile may be closed off (for example with a flow arrestor) allowing a restricted outflow of water or air from inside the pile. The restricted outflow may act as a brake preventing the pile from dropping freely when passing through very soft soils (in doing so shock loads to a crane when the pile drops may be reduced). Such a flow arrestor may be placed inside the hammer or can be placed separately in the pile. This is all possible due to the low acceleration levels of achieved by using the large mass as a hammer and the stationary positioning of the positioning element.

It will be clear to a person skilled in the art that features described in relation to any of the embodiments described above can be applicable interchangeably between the different embodiments. The embodiments described above are examples to illustrate various features of the invention.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The invention claimed is:

1. A pile-driver assembly for driving a pile into the ground, the assembly including:

a casing defining a chamber, the chamber being configured to house a fluid;

a positioning element configured to position the casing at or on the pile, wherein at least a portion of the positioning element is positioned between the chamber and the pile; and actuating means comprising at least one actuator, wherein the actuating means comprises a central moving element, having an extended position and a retracted position, wherein the actuating means comprises a buffering chamber, configured to house a buffering fluid, wherein the buffering chamber is configured so that the volume of the buffering chamber decreases as the central moving element moves from the extended position to the retracted position, wherein the actuating means comprises regulating means comprising one or more valves configured to regulate internal buffering characteristics of the actuating means, wherein the one or more valves are configured to control the amount of buffering fluid within the buffering chamber, wherein the actuating means is configured to be actuated to displace the chamber relative to the positioning element, such that the chamber moves away from the pile, and wherein the actuating means is configured to be actuated to release the chamber for displacement towards the pile such that a force is exerted by the chamber on the positioning element, to controllably drive the pile into the ground.

2. The assembly of claim 1, wherein the assembly further comprises buffering means comprising at least one buffering element for controllably buffering the force exerted by the chamber on the pile when the pile is driven into the ground.

3. The assembly of claim 1, wherein the actuating means is configured to, when actuated, cause the central moving element to move from the retracted position to the extended position and wherein the actuating means is configured to buffer the force exerted by the chamber on the positioning element as the central moving element moves from the extended position to the retracted position.

4. The assembly of claim 1, wherein the actuating means comprises a fluid chamber, configured to house a fluid, wherein an increase in the amount of fluid within the fluid chamber causes the central moving element to move from the retracted position towards the extended position.

5. The assembly of claim 4, wherein the actuating means further comprises an additional fluid chamber fluidly coupled to the first fluid chamber, wherein the central moving element is moved between the extended and retracted position depending on the fluid pressure of the fluid chambers.

6. The assembly of claim 5, wherein the fluid chambers are fluidly coupled by a valve element.

7. The assembly of claim 1, wherein the at least a portion of the positioning element is a plate element configured to overlay an upper surface of the pile.

8. The assembly of claim 7, wherein the positioning element further comprises a sleeve element releasably connected to an upper portion of the pile.

9. The assembly of claim 8, wherein the casing comprises a sleeve portion at an end thereof, wherein the sleeve portion is configured to surround the sleeve element of the positioning element to provide alignment between the positioning element and the casing.

10. The assembly of claim 1, the chamber having a channel extending at least partially therethrough.

11. The assembly of claim 10, wherein the positioning element comprises a guide element, configured to extend at least partially through the channel.

12. The assembly of claim 11, wherein the guide element is configured to extend further through the channel as the chamber moves towards the pile.

13. The assembly of claim 1, wherein the actuating means is located intermediate the chamber and the at least a portion of the positioning element.

14. A method of driving a pile into ground, the method comprising:

providing a pile, to be driven into the ground;

providing a pile driver assembly according to claim 1 in a coaxial arrangement at or in the pile;

actuating the actuating means such that the chamber is moved away from the pile; and further actuating the actuating means to release the chamber such that the chamber displaces towards the pile and exerts a force on the positioning element, to controllably drive the pile into the ground.

15. The method of driving a pile into ground according to claim 14, the method further comprising controllably buffering the force exerted by the chamber on the pile when the pile is controllably driven into the ground.

16. The method of driving a pile into ground according to claim 14, further comprising the steps of repeatedly actuating and further actuating the actuating means until the pile is driven, into a pre-set position, into the ground.

17. The method of driving a pile into ground according to claim 14, further comprising the step of substantially filling the chamber with a fluid.

18. The method of driving a pile into ground according to claim 17, wherein the fluid is water from an offshore location.

* * * * *